United States Patent [19]

Nagasawa et al.

[11] Patent Number: 4,542,730

[45] Date of Patent: Sep. 24, 1985

[54] METHOD AND APPARATUS FOR CONTROLLING AIR-FUEL RATIO OF MIXTURE FOR COMBUSTION ENGINES

[75] Inventors: Shiro Nagasawa, Kariya; Naruaki Morimoto, Anjo; Toshio Fujimura, Kariya; Masayuki Itoh, Chita; Shinya Taniguchi, Oobu, all of Japan

[73] Assignee: Nippondenso Co., Ltd., Kariya, Japan

[21] Appl. No.: 629,969

[22] Filed: Jul. 11, 1984

[30] Foreign Application Priority Data

Sep. 21, 1983 [JP] Japan ..... 58-175125

[51] Int. Cl.[4] ..... F02M 17/00

[52] U.S. Cl. ..... 123/489

[58] Field of Search ..... 123/440, 480, 489

[56] References Cited

U.S. PATENT DOCUMENTS 4,319,451 3/1982 Tajima et al. ..... 123/440 X
4,345,561 8/1982 Kondo et al. ..... 123/440
4,348,727 9/1982 Kobayashi et al. ..... 123/440 X
4,441,473 4/1984 Isomura et al. ..... 123/440

*Primary Examiner*—Tony M. Argenbright
*Attorney, Agent, or Firm*—Cushman, Darby & Cushman

[57] ABSTRACT

In an air-fuel ratio control with a learning control, a first correction values stored in a memory in correspondence to intake condition of a combustion engine and fuel injection time are renewed in response to an air-fuel ratio of mixture sensed in an exhaust of the combustion engine and a second correction value also stored in the memory is renewed in dependence on a difference between the first correction values stored in correspondence to the same intake condition. The first correction values are used to correct a basic fuel injection time determined by the operating condition, while the second correction value is used to correct an ineffective fuel injection time. Fuel is injected for an interval which is a sum of the corrected basic fuel injection time and the corrected ineffective fuel injection time.

5 Claims, 4 Drawing Figures

METHOD AND APPARATUS FOR CONTROLLING AIR-FUEL RATIO OF MIXTURE FOR COMBUSTION ENGINES

BACKGROUND OF THE INVENTION

The present invention relates to a method and apparatus for controlling an air-fuel ratio of mixture to be supplied to a combustion engine, and more particularly to the ones for controlling a fuel injection time with learning control in response to a sensed air-fuel ratio.

In a conventional air-fuel ratio control system for a combustion engine, a fuel injection system has been employed to electronically control a fuel injection time. The fuel injection time has been determined by operating conditions of the combustion engine such as an intake air quantity, rotational speed of the engine or the like and by an ineffective fuel injection time which is independent of the operating condition.

To compensate for manufacturing differences and secular changes in operating characteristics of the fuel injection system, it has been proposed in U.S. Pat. Nos. 4,345,561 and 4,348,727 assigned to the same assignee of this patent application, for example, to employ a learning control in response to an air-fuel ratio of mixture sensed in an exhaust of the combustion engine. In the learning control, a plurality of correction values stored in a memory in correspondence to the operating conditions of the combustion engine are renewed in response to the sensed air-fuel ratio so that, when the combustion engine is operated in the same condition as in the previous time, the correction value renewed in the previous time and indicative of the most desirable correction is used to correct, in anticipation, the fuel injection time determined in dependence on the operating conditions.

The learning control, however, has not been directed to the other items such as the ineffective fuel injection time of fuel injectors which, although independent of the operating conditions, have manufacturing differences and secular changes.

Therefore, the characteristic changes of the system have not been compensated satisfactorily, resulting in the unsatisfactory air-fuel ratio control system.

SUMMARY OF THE INVENTION

It is therefore a primary object of the present invention to obviate abovenoted drawbacks.

It is a further object of the present invention to apply a learning control even to items independent of the operating conditions of the combustion engine.

It is a still further object of the present invention to apply a learning control even to an ineffective fuel injection time of a fuel injector employed in an air-fuel ratio control system.

According to a preferred embodiment of the present invention, a first correction values stored in a memory in correspondence to intake conditions of a combustion engine and fuel injection time are renewed in response to an air-fuel ratio of mixture sensed in an exhaust of the combustion engine and a second correction value also stored in the memory is renewed in dependence on a difference between the first correction values stored in correspondence to the same intake condition. The first correction values are used to correct a basic fuel injection time determined by the operating conditions, while the second correction value is used to correct an ineffective fuel injection time. Fuel is injected for an interval which is a sum of the corrected basic fuel injection time and the corrected ineffective fuel injection time.

DETAILED DESCRIPTION OF THE PREFERRED EMBODIMENT

The present invention will be described with reference to a preferred embodiment shown in the accompanying drawings.

Figure 1:
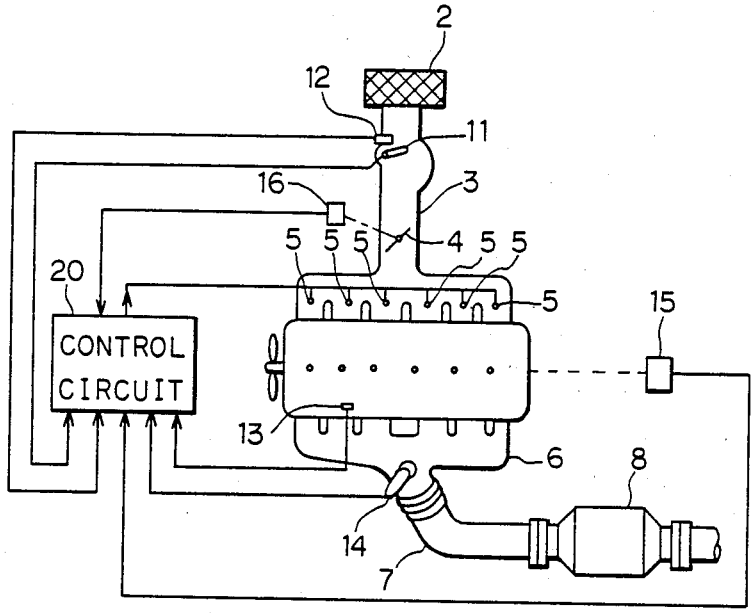
FIG. 1 is a schematic diagram illustrating an embodiment of an air-fuel ratio control system according to the present invention.

Referring to FIG. 1, numeral 2 designates an air cleaner, numeral 3 an intake passage connected with the air cleaner 2, and 4 a throttle valve positioned in the intake passage 3. Numeral 5 designates an electro-magnetically operated fuel injector positioned in an intake manifold for each cylinder of an engine. The fuel injector 5 controlled by a control circuit 20 opens at a predetermined timing to supply the engine with a pressurized fuel for a period of time determined in dependence on operating conditions of the engine. Numeral 6 designates an exhaust manifold, numeral 7 an exhaust passage, and numeral 8 a 3-way catalytic converter provided in the exhaust passage 7. In the exhaust manifold 6, an air-fuel ratio sensor 14 is provided. The sensor 14 detects the air-fuel ratio of mixture supplied to the engine in response to the oxygen content in the exhaust gas and provides high and low level output signals when the detected air-fuel ratio A/F is richer and leaner than a stoichiometric one, respectively. Numeral 11 designates an intake air quantity sensor positioned in the intake passage 3. The sensor 11 provides an analog voltage signal which is indicative of the quantity of air Q sucked into the engine. Numeral 12 designates an intake air temperature sensor having a thermistor for providing an analog voltage signal indicative of the intake air temperature $T_A$, numeral 13 a coolant temperature sensor having a thermistor for providing an analog voltage signal indicative of the coolant temperature $T_C$ of the engine, numeral 16 a throttle opening sensor for providing a digital signal indicative of the opening angle $\theta$ of the throttle valve 4. Numeral 15 designates a rotation sensor which provides a train of pulse signals having a frequency proportional to the rotational speed of the engine.

The control circuit 20 calculates required interval of time for fuel injection in response to the output signals from the sensors 11 through 16 and controls the opening interval of time of the injector 5 so that air-fuel ratio control can be performed.

Figure 2:
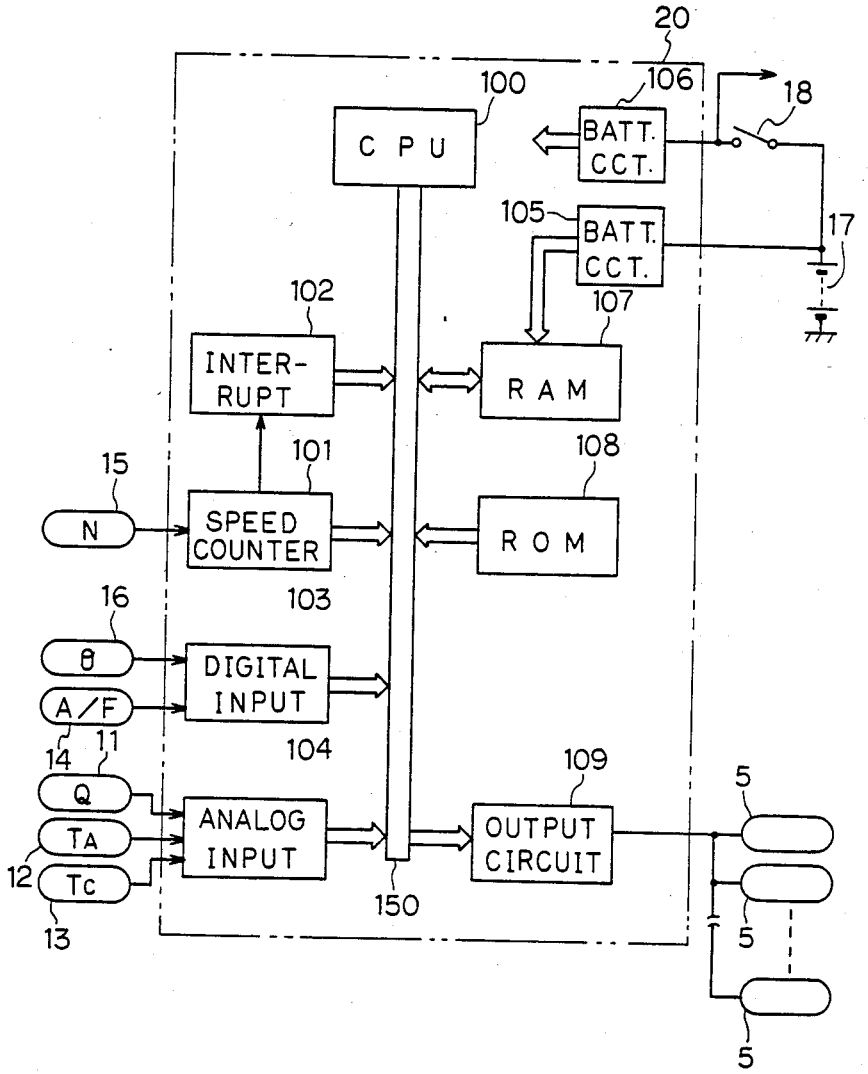
FIG. 2 is an electric wiring diagram illustrating in detail a control circuit of FIG. 1.

As shown in FIG. 2, the control circuit 20 is primarily comprised of a microcomputer. In FIG. 2, numeral 100 designates a central processing unit (CPU) which performs various executions based on a program stored in a read only memory (ROM) 108, and numeral 101 a rotational speed counter which measures the rotational speed of the engine in response to the pulse signals from the rotation sensor 15. Numeral 102 designates an interrupt control unit which, upon receipt of an output from the rotational speed counter 101, provides the CPU 100 with an interrupt command through a common bus 150 at every rotation of the engine. Numeral 103 designates a digital input port which receives digital signals from the air-fuel ratio sensor 14 and the throttle opening sensor 16 and transmit them to CPU 100 through the bus 150. Numeral 104 designates an analog input port comprising an analog multiplexer and an A/D converter which sequentially converts analog signals from the intake air quantity sensor 11, intake air temperature sensor 12 and coolant temperature sensor 13 into digital signals to be used by the CPU 100. Numeral 17 designates a battery, numeral 18 a key switch, and numeral 106 a battery circuit for supplying electric power to circuit components of the control circuit 20 except a random access memory (RAM) 107. The RAM 107 is supplied with the electric power from a battery circuit 105 connected directly to the battery 17. For this reason, the RAM 107 is always supplied with the electric power to keep the stored information therein such as correction values K1 and K2 described later even after the key switch 18 is turned off to stop the engine. Numeral 109 designates an output circuit comprising a latch, counter and power transistors. The output circuit 109 provides a driving signal for opening the fuel injector 5 for the interval of time calculated by the CPU 100.

Figure 3:
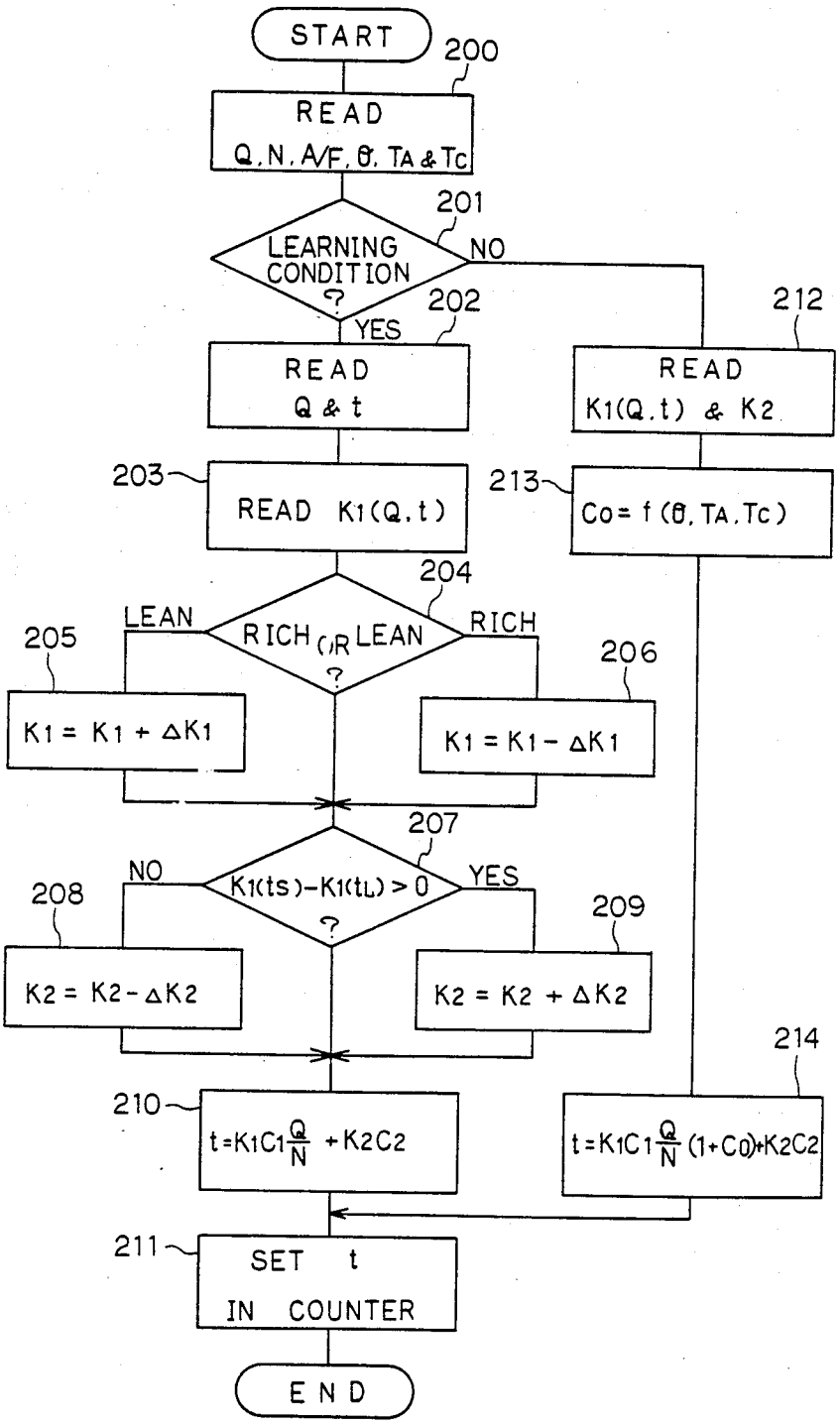
FIG. 3 is a flow chart illustrating a sequence of operation of a microcomputer used as the control circuit of FIG. 2.

Reference is now made to FIG. 3 and the operation of the control circuit 20 will be described in detail with reference to a flow chart therein. When the CPU 100 receives the interrupt command, from the interrupt control unit 102, engine operating conditions Q, N, A/F, $\theta$, $T_A$ and $T_C$ provided by the counter 101 and input ports 103 and 104 are read and stored in RAM 107 for a later use. Then, a $\theta$ step 201 is executed to decide whether a learning control should be made or not. The learning control is performed when no fuel enrichment is required by the air intake temperature sensor 12, coolant temperature sensor 13 and throttle opening sensor 16.

Figure 4:
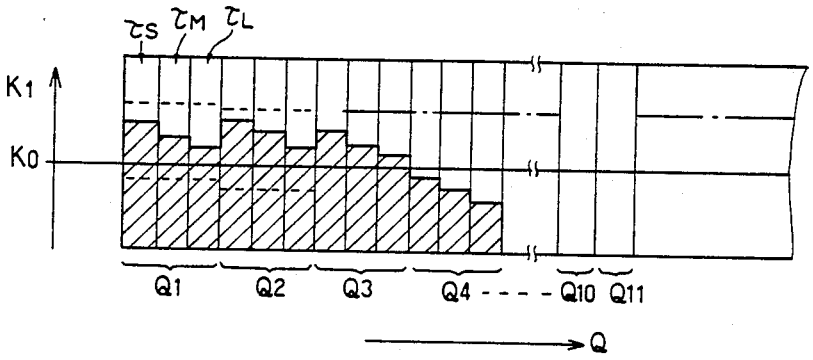
FIG. 4 is a chart illustrating first correction values stored in a random access memory of the microcomputer.

If the learning condition is not satisfied, the execution proceeds to a step 212 and the first and second correction values K1 and K2 stored in the RAM 107 are read out. As shown in FIG. 4, the RAM 107 stores therein three first correction values K1 in correspondence to the short, medium and long fuel injection times $t_S$, $t_M$ and $t_L$ for each intake air quantity Q1, Q2, . . . , Qn. Reading one value K1 (Q, t) is performed by addressing a particular storage location in response to the intake air quantity Q and the fuel injection time t which are obtained previously for example. Then at a step 213, a fuel enrichment value $C_0$ is determined in response to the detected values $\theta$, $T_A$ and $T_C$. After the step 213, a fuel injection time t is calculated at a step 214 based on the predetermined following equation.

$$t = K1C1Q/N(1+C_0)+K2C2 \text{ (C1 and C2: constants)}$$

On the other hand, if the learning condition is satisfied, the execution proceeds to a step 202. At the step 202, the previous fuel injection time t and the previous intake air quantity Q are read out from the RAM 107 and, at a step 203, the first correction value K1 stored in the RAM 107 is read out in accordance with the intake air quantity Q and the fuel injection time t obtained at the step 202. As shown in FIG. 4 and described before, the RAM 107 stores a plurality of correction values K1 in storage locations defined by the intake air quantity Q1–Q11 and fuel injection time $t_L$, $t_M$ and $t_S$. As will be described later, these correction values K1 are corrected by a learning control after a step 204.

At the step 204, the output signal of the air-fuel ratio sensor 14 stored at the step 200 is checked. When the detected air-fuel ratio is lean, the correction value K1 obtained at the step 203 is added with a predetermined value ΔK1 to incrementally correct the first correction value K1. On the other hand when the detected air-fuel ratio is rich, the first correction value K1 is substructed by a predetermined amount ΔK1 at a step 206 to decrementally correct the first correction value K1. If the detected air-fuel ratio is just around the stoichiometric ratio, no correction of the first correction value K1 is performed. After the steps 205 and 206, the first correction values K1 corresponding to the long fuel injection time $t_L$ and the first correction value K1 corresponding to the shoft fuel injection time $t_S$ are compared at the step 207. If the first correction value K1 corresponding to the short fuel injection time $t_S$ is larger than the first correction value K1 corresponding to the long fuel injection time $t_L$ the second correction value K2 is increased by an amount ΔK2 at a step 209. On the other hand, when the first correction value K1 corresponding to the short fuel injection time $t_S$ is smaller than the first correction value K1 corresponding to the long fuel injection time $t_L$, the second correction value K2 is decreased by an amount ΔK2 at a step 208.

It should be noted that, as shown in a map of FIG. 4, the first correction value K1 is larger or the air-fuel ratio A/F is richer as the fuel injection time t is smaller, if the ineffective fuel injection time is smaller than necessary. To correct this, the second correction value K2 must be incrementally or decrementally corrected at the steps 208 and 209.

Thus, after the first correction value K1 for the basic fuel injection time and the second correction value K2 for the ineffective fuel injection time are corrected, a step 210 is executed to determine the final fuel injection time t based on the following equation.

$$t = K1C1Q/N+K2C2$$

At a step 211, the fuel injection time t calculated at the step 210 or 214 is set into a counter of the output circuit 109 so that the output circuit 109 opens the fuel injector 5 in accordance with the calculated fuel injection time.

It should be noted that, while the second correction value K2 is decreased and increased during the operation of the engine, the difference between the first correction values K1 ($t_S$) and K1($t_L$) obtained at the step 207 is decreased and the ineffective fuel injection time becomes uniform as it should be. As a result, the difference between the fuel injection times due to the error in the ineffective fuel injection time can be obviated.

The present invention having been described above with reference to a particular embodiment should not be limited thereto and may be modified in many ways without departing from the scope and spirit of this invention.

For instance, although three first correction values K1 are stored in dependence on the length of the fuel injection time t for each area of the intake air quantity Q in the embodiment, the number of first correction values K1 may be increased or decreased as long as at least two values are stored for each area of the intake air quantity Q. The number of first correction values K1 may be different from area to area of intake air quantity Q in such a manner that more number of first correction values K1 are stored for a lesser quantity of intake air Q where the learning control is more desired and the ineffective fuel injection time is more influential.

What we claim is:

1. A method of controlling an air-fuel ratio of mixture to be supplied to a combustion engine comprising the steps of:

storing a plurality of first correction values and a second correction value in a memory, said first correction values being stored in storage locations of said memory addressable by two predetermined parameters;

sensing an intake condition of said combustion engine, said second intake condition being used as one of said two predetermined parameters for addressing said memory;

sensing an air-fuel ratio of mixture supplied to said combustion engine;

correcting, in response to said sensed air-fuel ratio, one of said first correction values stored in one of said storage locations corresponding to said second intake condition and the other of said two predetermined parameters;

correcting said second correction value in response to a difference between said first correction values stored in said storage locations corresponding to the same sensed intake condition;

newly storing said corrected one of said first correction values and said corrected second value in said memory in place of said one of first correction values and said second correction value, respectively;

determining a fuel injection time by adding a first time dependent on said sensed intake condition and a second time independent of said sensed intake condition, said fuel injection time being used as the other of said two predetermined parameters for addressing said memory, said first time and said second time being proportional to said corrected one of said first condition values and said corrected second correction value, respectively; and injecting fuel into said combustion engine during said determined fuel injection time.

2. A method according to claim 1, wherein said determining step includes the steps of:

calculating said first time by multiplying said one of said first correction values and a value corresponding to said sensed air condition; and calculating said second time by multiplying said second correction value and a constant value.

3. A method according to claim 2, wherein said intake condition sensing step comprises the step of sensing a quantity of air sucked into said combustion engine.

4. A method of controlling an air-fuel ratio of mixture to be supplied to a combustion engine comprising the steps of:

storing a plurality of first correction values and a second correction value in a memory, said first correction values being stored in storage locations of said memory addressable by two predetermined parameters;

sensing a quantity of intake air sucked into said combustion engine, said sensed intake condition being used as one of said two predetermined parameters for addressing said memory;

sensing a rotational speed of said combustion engine;

sensing from an exhaust of said combustion engine an air-fuel ratio of mixture supplied to said combustion engine;

deciding whether or not a learning condition is satisfied in response to operating conditions of said combustion engine;

correcting, in response to said sensed air-fuel ratio, one of said first correction values stored in one of said storage locations corresponding to said sensed quantity of intake air and the other of said two predetermined parameters, when said learning condition is satisfied;

correcting said second correction value in response to a difference between said first correction values stored in said storage locations corresponding to the same sensed quantity of intake air, when said learning condition is satisfied;

newly storing said corrected one of said first correction values and said corrected second value in said memory as said one of first correction values and said second correction value, respectively;

determining a fuel injection time by adding a first time and a second time, said first time being proportional to said one of correction values and said sensed quantity of intake air and inversely proportional to said sensed rotational speed, said second time being proportional to said second value but independent of said sensed quantity of intake air and said sensed rotational speed, and said fuel injection time being used as the other of said two predetermined parameters for addressing said memory; and injecting fuel into said combustion engine during said determined fuel injection time.

5. An apparatus for controlling an air-fuel ratio of mixture to be supplied to a combustion engine comprising;

means for sensing an intake condition of said combustion engine;

means for sensing an air-fuel ratio of mixture supplied to said combustion engine;

memory means for storing a plurality of first correction values and a second correction value, said first correction values being stored in storage locations corresponding to two predetermined parameters one of which is said sensed intake condition;

processor means being programmed to correct in response to said sensed air-fuel ratio one of said first correction values stored in one of said storage locations corresponding to said second intake condition and the other of said two predetermined parameters;

said processor means being programmed to correct said second correction value in response to a difference between said first correction values stored in said storage locations corresponding to the same sensed intake condition;

said processor means being programmed to replace said one of said first correction values and said second correction valve by said corrected one of first correction value and said corrected second value, respectively;

said processor means being programmed to determine a fuel injection time by adding a first time and a second time, said first time being proportional to said corrected one of first correction values and said sensed intake condition, said second time being proportional to said corrected second correction value but independent of said sensed intake condition, and said determined fuel injection time being used as the other of said two predetermined parameters for addressing said memory; and injection means for injecting fuel into said combustion engine during said determined fuel injection time.

* * * * *